United States Patent [19]

Lyles

[11] 4,359,011

[45] Nov. 16, 1982

[54] BOAT MOORING SYSTEM FOR A PLATFORM STRUCTURE

[75] Inventor: Christopher J. Lyles, Los Angeles, Calif.

[73] Assignee: Amtel, Inc., Providence, R.I.

[21] Appl. No.: 14,079

[22] Filed: Feb. 22, 1979

[51] Int. Cl.[3] ..... B63B 21/00

[52] U.S. Cl. ..... 114/230; 114/293

[58] Field of Search ..... 114/230, 263, 293, 45; 9/8 R, 8 P; 141/279, 284, 387, 388

[56] References Cited

U.S. PATENT DOCUMENTS

| | | | |
|---|---|---|---|
| 3,430,598 | 3/1969 | Soderberg | 114/230 |
| 3,783,816 | 1/1974 | Chassy et al. | 9/8 P |
| 3,817,201 | 6/1974 | Tellberg | 114/230 |
| 3,971,329 | 7/1976 | Kosmatka | 114/230 |

*Primary Examiner*—Trygve M. Blix

*Assistant Examiner*—Jesus D. Sotelo

*Attorney, Agent, or Firm*—Freilich, Hornbaker, Wasserman, Rosen & Fernandez

[57] ABSTRACT

A system is described for use with a platform structure which is anchored at a fixed location and orientation in deep water, to hold a supply boat at a substantially fixed location and compass heading so that cranes or the like on the platform can reach the boat to lift off cargo, which is of the type that utilizes a pair of hawsers to tie the stern of the boat to the platform and another hawser to tie the bow of the boat to a buoy anchored far from the platform. A long underwater beam structure is utilized which lies under the boat, has an inner end pivotally connected to the platform structure, and has an outer end which anchors the buoy in position, so that the buoy does not have to be separately anchored to the sea floor.

14 Claims, 11 Drawing Figures

FIG. 1
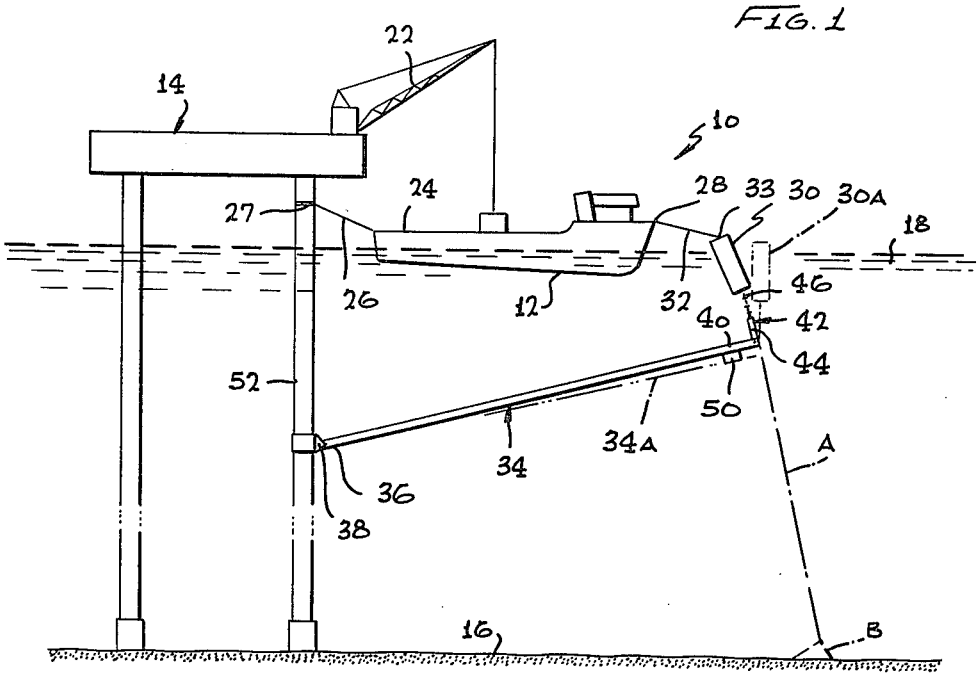
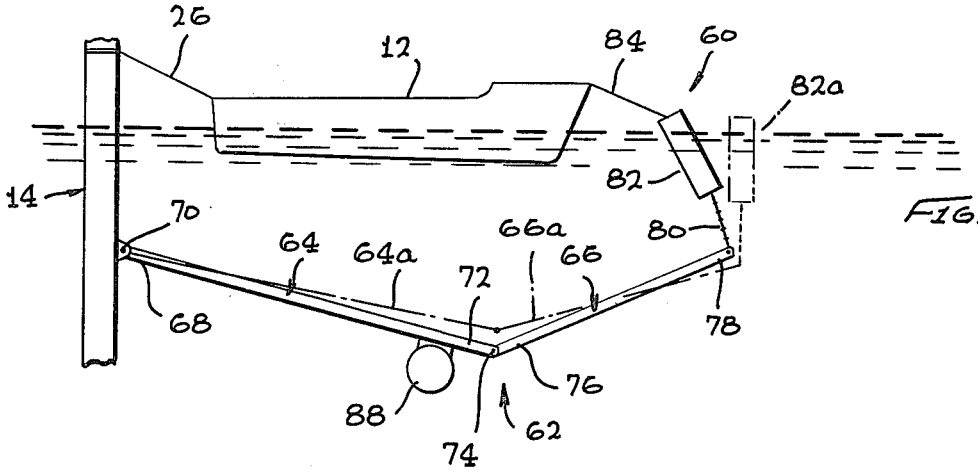
FIG. 3
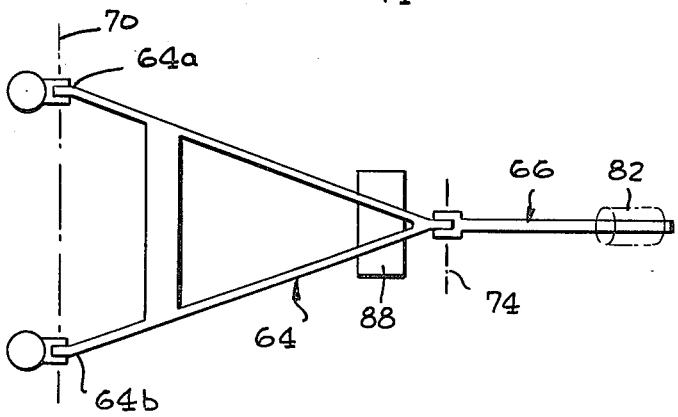
FIG. 4

FIG. 6
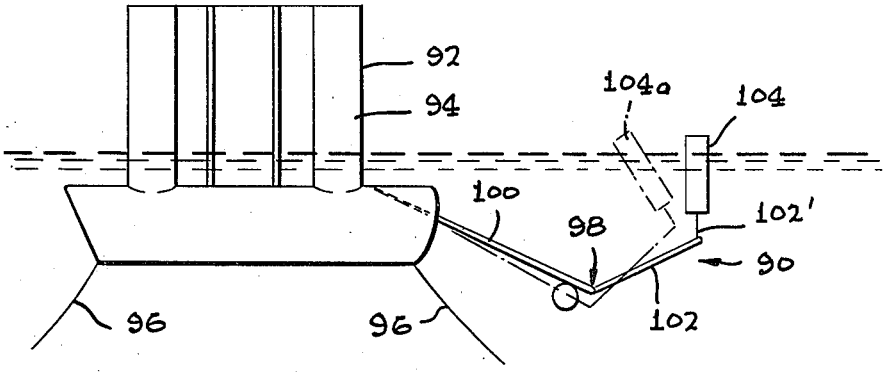
FIG. 7
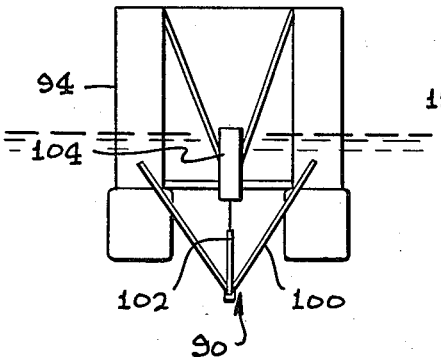
FIG. 10
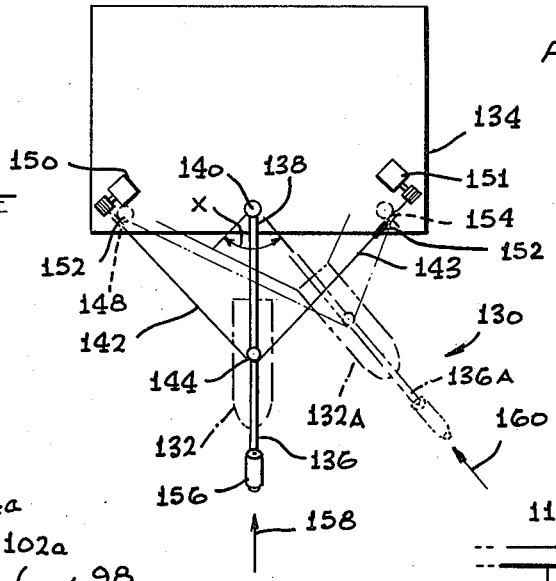
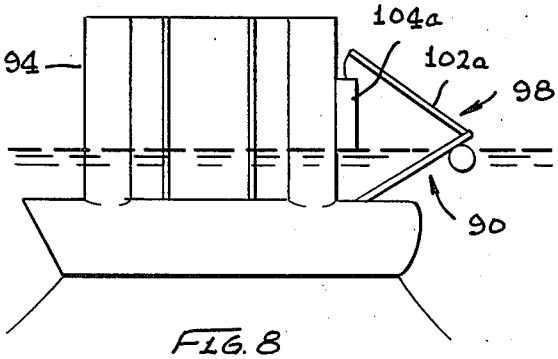
FIG. 8
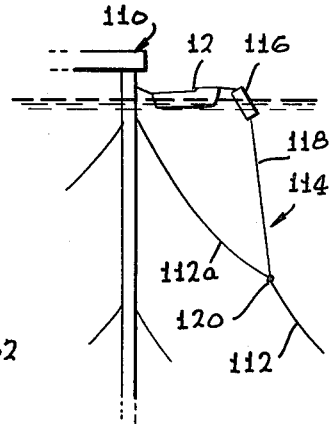
FIG. 9
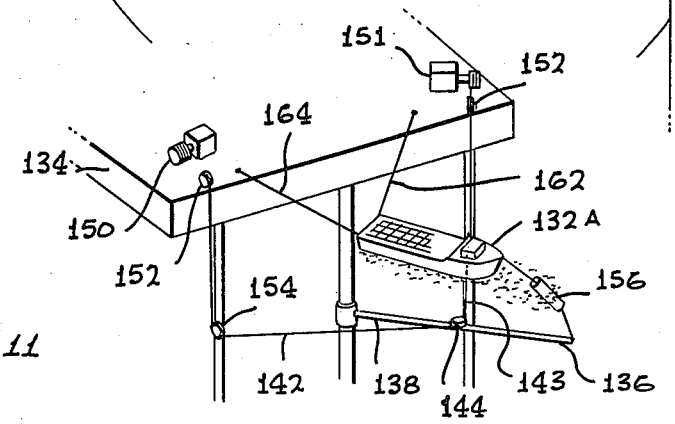
FIG. 11

BOAT MOORING SYSTEM FOR A PLATFORM STRUCTURE

BACKGROUND OF THE INVENTION

Offshore platform structures are moored to ships during the transfer of oil between the platform and a tanker, and also during the transfer of supplies from a supply boat to the platform. Many systems have been developed for mooring and cargo transfer of a tanker, which generally involve the use of hoses to carry oil or other hydrocarbons between the platform and tanker. Such systems also generally include structures that hold the tanker close enough to the platform structure to avoid breaking the hoses while permitting the tanker to freely drift about the platform structure. A different type of mooring approach is required in the mooring of supply boats, from which cargo such as large cartons are to be transferred to the platform structure by large cranes on the structure. Such transfer of cargo from a supply boat requires that it be held at a substantially fixed location and compass heading.

A conventional mooring method employed for supply boats unloading at an offshore platform, requires the stern of the vessel to be moored by two quarter lines to the platform structure, while the engines of the vessel are operated to keep the quarter lines taut. Another method is to use a buoyed cable which is anchored to the seabed, and which the supply boat picks up and attaches to its own anchor cable. The supply boat then backs down to the platform to apply tension to the anchored cable. The reliance upon the supply boat's own engines or anchor system has been found to be hazardous.

An improved supply boat mooring technique involves the use of a mooring buoy which is anchored by a chain to a mooring base at the seabed, and with the top of the buoy being attached by a hawser to the bow of the supply boat. Tension in the hawser causes the buoy to tip, which results in a restoring force that keeps the hawser taut. While this mooring system operates well, it can lead to considerable expense in deep water installations. The secure emplacement of a mooring base at great depths such as over 100 meters, is considerable, and the cost of maintenance where divers have to descend to the mooring base, is also considerable. A mooring system for mooring supply boats to deep water platform structures, which provided reliable holding of the supply boats while avoiding the expense of installing and maintaining mooring bases at the great depths of the seabed, would be of considerable value in reducing the cost of offshore installations.

SUMMARY OF THE INVENTION

In accordance with one embodiment of the present invention, a boat mooring system is provided for use with a deep water platform structure, which reliably holds a boat at a substantially fixed position and compass heading, and yet which minimizes the cost of installation and maintenance. The system includes a connecting structure having an inner end coupled to the platform structure at a location far above the seabed and an outer location spaced from the platform structure by a distance greater than the length of the boat to be moored. One end of the boat is tied by at least one hawser line to the platform structure, while the other end of the boat is tied by a hawser line to the outer location of the connecting structure, and with the hawser line being pulled taut to hold the boat in a controlled position and compass heading.

The connecting structure can be formed by a long beam with an inner end pivotally connected to the platform structure and an outer end far from the platform structure. A negatively buoyant beam can be used, together with a buoy connected by a chain or other tension device to the outer end of the beam, so that the buoy supports the beam in a largely horizontal orientation and so that the beam holds the buoy in approximate location. A hawser line extends between an end of the vessel and the buoy, so that tension in the hawser line pulls the buoy towards the vessel and causes energy storage that urges the buoy to return to its initial position. The beam and buoy can be positioned so that the beam initially extends at a slight upward incline towards its buoy-holding end, so that tension in the hawser line connected to the buoy, stores energy not only by lifting the buoy partially out of the water but also by lifting the negatively buoyant beam.

Another connecting structure is formed by a pair of beams connected in series, with the inner end of a first beam pivotally connected to the platform structure and the outer end of the second beam supporting a tension device that extends up to a buoy. The first beam is positively buoyant and extends at a slight downward incline from the platform structure, while the second beam is negatively buoyant and extends at a slight upward incline towards the buoy. Tension in the hawser connecting the buoy to an end of the boat, causes energy storage partially by lowering the positively buoyant first beam.

The novel features of the invention are set forth with particularity in the appended claims. The invention will be best understood from the following description when read in conjunction with the accompanying drawings.

BRIEF DESCRIPTION OF THE DRAWINGS

FIG. 1 is a side elevation view of a platform and boat mooring system, constructed in accordance with one embodiment of the invention.

FIG. 3 is a partial side elevation view of a platform and boat mooring system constructed in accordance with another embodiment of the invention.

FIG. 4 is a partial plan view of the system of FIG. 3.

FIG. 6 is a side elevation view of a mooring installation for a semi-submersible platform structure, constructed in accordance with another embodiment of the invention, shown in a deployed configuration.

FIG. 7 is an end elevation view of the system of FIG. 6.

FIG. 8 is a side elevation view of the system of FIG. 6, but shown in a stowed configuration.

FIG. 9 is a partial side elevation view of a mooring structure constructed in accordance with another embodiment of the invention.

FIG. 10 is a plan view of a mooring system constructed in accordance with another embodiment of the invention, which enables adjustment of the heading of a moored boat.

FIG. 11 is a partial perspective view of the mooring system of FIG. 10.

DESCRIPTION OF THE PREFERRED EMBODIMENTS

Figure 2:
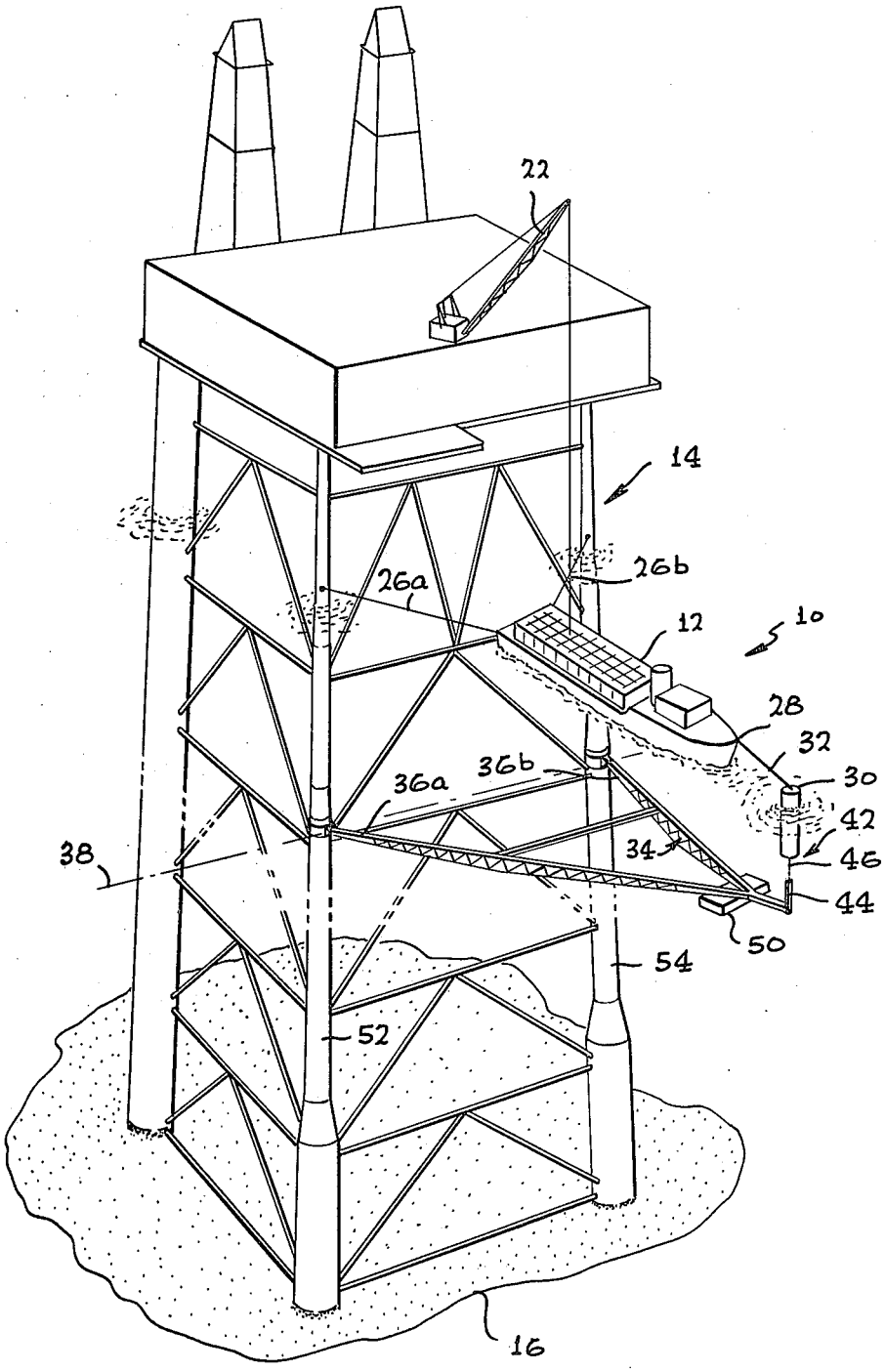
FIG. 2 is a more detailed perspective view of the system of FIG. 1.

FIG. 1 illustrates a platform and boat mooring system 10 which is utilized to moor a supply boat 12 close to a platform structure 14. The platform structure 14 extends from a seabed 16 lying hundreds of meters below the sea surface 18, and the platform structure is fixed in position and orientation by a group of legs such as 52 that extend down to the seabed and are anchored thereat. The supply boat 12 can be utilized to carry equipment, packaged food, and other items to personnel on the platform structure 14. Transfer of supplies from the boat to the platform structure can be accomplished by a crane 22 that can extend over the boat. Such transfer of supplies can be accomplished by mooring the boat so it is maintained at a substantially fixed position and orientation, or compass heading, with respect to the platform structure 14 and the seabed 16 on which the platform structure is substantially fixedly located. This can be accomplished by connecting one end portion of the boat such as the stern 24 to the platform structure as by a pair of hawsers 26 held by connecting means 27 on the platform structure, and connecting the other end such as the bow 28 to a buoy 30 that is resiliently anchored in position, by an additional hawser 32 held to a connecting means 33 on the buoy. When the hawsers 26, 32 are pulled taut, the boat is held to a particular location and heading. However, slight boat movement can occur due to the resilient mooring of the buoy 30, which helps to avoid damage to the boat by allowing it to "give" under the action of waves.

The anchoring of the buoy 30 in position, must be accomplished in a manner that holds the buoy closely in position and with high reliability. One advanced prior art method has involved the use of an anchor chain, indicated at A, which extended down to a mooring base B securely held to the seabed as by utilizing a massive ballast-filled chamber. Where the depth of the seabed 16 is large, such as much more than one hundred meters, high costs are involved in installing and maintaining the base structure B. In accordance with the present invention, a beam structure 34 can be utilized to hold or anchor a buoy 30 in position, to resiliently pull on an end of the boat 12, without requiring the installation of an anchoring base at the great depth of the seabed 16. The beam structure 34 is in the form of a long arm or beam which has an inner end 36 pivotally mounted about a horizontal axis 38 to the platform structure 14. The beam structure 34 has an outer end 40 which is connected by a tension device or coupling 42 to the bottom of the buoy 30 to hold it in position. The coupling 42 includes a link 44 pivotally connected at its lower end to the beam end 40, and a chain 46 which connects the upper end of the link to the buoy.

The beam 34 includes a weight 50 that makes the beam negatively buoyant. When the buoy 30 is not connected to a ship, as at the position 30A, the buoy holds the beam at the position 34A. When the hawser 32 which connects the upper end of the buoy 30 to the bow of the boat, is pulled taut, the buoy 30 is tilted and, in the situation of FIG. 1, the buoy 30 is pulled slightly higher out of the water and the beam 34 is raised to the position shown. Both the raising of the buoy 30 and of the beam 34 results in the absorption of potential energy. Thus, when waves bear against the boat 12 and push it towards the platform structure 14, the buoy 30 provides some resilience to permit slight backward movement of the boat, but with a bias that tends to restore the boat to its initial position when the wave passes. The beam 34 extends at an upward incline from its inner end 36 to its outer end 40, so that pulling of the buoy and therefore of the outer end 40 towards the platform structure 14 causes lifting of the beam. The beam 34 lies at a greater depth than the boat 12, to avoid interference with the boat, but the beam lies far above the deep water seabed 16 to facilitate access to the beam. The inner end 36 of the beam is preferably mounted on the platform structure at a location below the sea surface 18, but much closer to the sea surface 18 than to the seabed 16.

As shown in FIG. 2, which shows additional details of the mooring system 10, the beam 34 is in the form of a yoke, with a pair of widely spaced inner end portions at **36*a*, 36*b* that are each pivotally mounted about the horizontal axis 38 by corresponding bearings mounted on legs 52, 54 of the platform structure. The wide spacing of the inner end portions of the yoke-like beam, is provided, to enable the beam to withstand large horizontal bending forces, which can result when the bow 28 of the vessel tends to move to one side to change the compass heading of the boat. It may be noted that column strength of the beam is enhanced by utilizing a latticed truss beam structure. The stern of the boat is held by two hawsers 26*a*, 26*b* to the platform structure. In one system designed in accordance with FIGS. 1 and 2, the beam 34 had a length of one hundred meters and its inner end at 36** was mounted fifty meters below the sea surface, on a platform structure mounted on a seabed at a depth of hundreds of meters below the sea surface.

FIGS. 3 and 4 illustrate another platform and boat mooring system 60 which utilizes a beam structure 62 that includes two beams 64, 66 connected in series. A first beam 64 has an inner end 68 connected about a horizontal axis 70 to the platform structure 14. The outer end 72 of the first beam is pivotally connected at 74 to the inner end 76 of the second beam 66. The outer end 78 of the second beam is connected by a tension coupling device 80 to a buoy 82. The top of the buoy is connected by a hawser 84 to the boat 12 in the same manner as for the system of FIG. 1.

Figure 5:
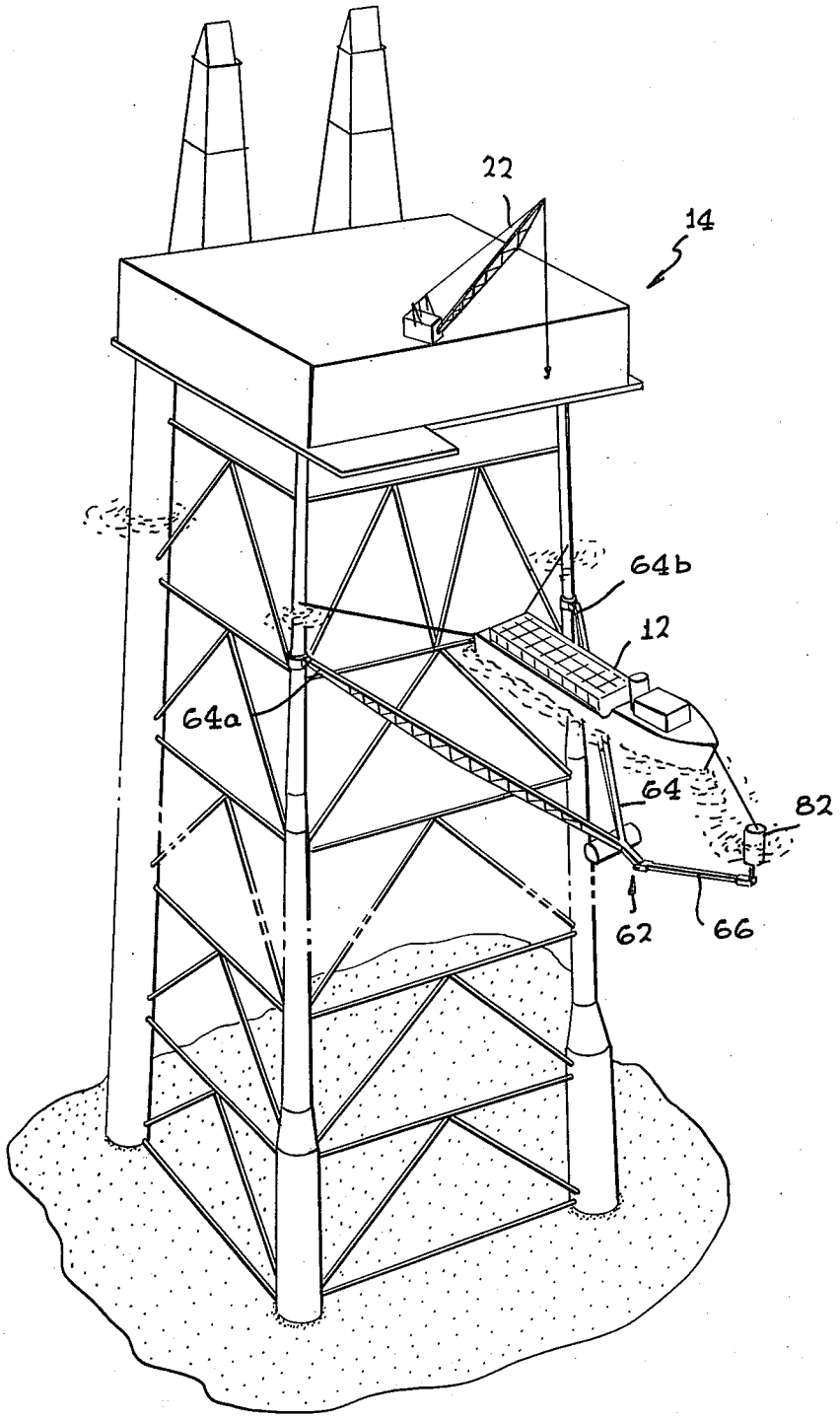
FIG. 5 is a more detailed perspective view of the system of FIG. 3.

In the beam structure 62, the first beam 64 includes a buoyancy chamber 88 that makes the first beam 64 positively buoyant. The second beam 66 is negatively buoyant. In the quiescent position at **82*a* of the buoy, it holds the beams at the positions 64*a*, 66*a*, by supporting the outer end of the second beam 66*a* at a predetermined depth below the sea surface. The negative buoyancy of the second beam 66*a* causes it to press down on the first beam to hold it at the position 64*a*. When the buoy is tied by a hawser to a boat 12, the buoy tips as to the position 82, and also rises slightly in the water. At the same time, it causes the second beam 66 to pivot and thereby lower the first beam to the position 64. The lowering of the first beam 64 plus raising of the buoy 82, results in absorption of potential energy, so that the structure resiliently pulls on the hawser 84. As also shown in FIG. 5, the long first beam 64 is a yoke beam having a pair of widely spaced inner ends 64*a*, 64*b* that are pivotally mounted on the platform structure 14**.

FIGS. 6–8 show a connecting structure 90 utilized with a semi-submersible platform structure 92 which is the type of structure that includes a floating platform 94 held by catenary chains 96 to the seabed to hold the floating platform 94 in a substantially constant position and compass orientation. The connecting structure 90 includes a beam structure 98 of the type that has an inner beam 100 connected to the platform structure 92 and a second beam 102 connected in series with the first beam, and also includes a coupling 102' extending from the second beam and a buoy 104 held by the coupling. A moored ship can tilt and slightly displace the buoy, as to the position 104*a*. The semi-submersible platform structure 92 can be moved from one location to another. In this connection, FIG. 8 shows how the connecting structure 90 can be stowed on a floating platform 94 during movement to a new site. The beam structure 98 is folded upwardly, so that the second beam is jack-knifed at 102*a* to hold the float 104*a* on the semi-submersible platform 94.

FIG. 9 shows a platform and mooring system, of a type wherein a platform structure 110 is held by catenary chains such as 112 that extend down to the seabed. The connecting structure 114 for holding an end of a boat 12, includes a buoy 116 tied by a hawser to the boat, a chain or other line 118 that extends downwardly from the buoy and is tied to the catenary chain 112, and also includes the upper portion 112*a* of the catenary chain. The tying at 120 of the lower end of the line 118 to the catenary chain, avoids the need to separately tie the line 118 to the seabed. However, since damage can result if the line 118 or catenary 112 breaks or pulls loose with respect to a seabed anchor, provisions should be made to securely anchor the catenary chain to the seabed and a heavy chain and line 118 should be utilized.

FIGS. 10 and 11 illustrate a platform and mooring system 130 which can moor a boat 132 close to a platform structure 134 and at any compass heading of the boat within a wide range such as within an angular orientation X of 90°. The system includes a beam 136 having an inner end 138 that is pivotally connected to the platform structure 134 to permit the beam to pivot about a substantially vertical axis 140. However, the beam 136 can be securely held at any position within a wide angle X by a pair of tying means in the form of tying lines 142, 143. The lines have outer ends connected to a holder 144 on the beam 136, at a location spaced from the inner end 138 of the beam. The deployed lengths of the lines 142, 143 determine the angular position of the beam 136, and therefore the compass heading of the boat 132. The deployed length of each line 142, 143 can be altered by operating a corresponding winch 150, 151 that can wind up or deploy the line about a pair of sheaves at 152 and 154. A buoy 156 is tied to the outer end of the beam 136 and is connected by a hawser to the bow of the boat.

The boat at 132 in FIG. 10 is at a compass heading that minimizes sideward forces on the boat due to currents, wind, and waves in the direction of arrow 158. If the currents are, instead, in the direction of arrow 160, the winches 150, 151 can be operated to lengthen one line 142 and shorten the other 143, while one of the stern hawsers 162 is shortened and the other one 164 is lengthened. The boat 132 also can be steered with its rudder and propeller, until it is at the orientation 132A. The lines 142, 143 which have been respectively lengthened and shortened, will then hold the beam at the position 136A. The arrangement of FIGS. 10 and 11 therefore can hold the boat at a substantially fixed position and compass orientation or heading (i.e. orientation as seen in a plan view) within a wide range, to minimize stresses on the boat and on the mooring system.

Accordingly, the invention provides a platform structure and mooring system, which hold a boat, and especially a supply boat, in a closely controlled position and compass heading adjacent to a platform structure that is anchored in deep water at a substantially fixed position and compass orientation, in a manner that can avoid installation and maintenance work on a seabed anchoring structure lying at a great depth. This is accomplished by utilizing a connecting structure that has an inner end coupled to the platform structure and an outer end spaced further from the platform structure than the boat and which is connected by a hawser line to the boat so that tautness of the hawser line pulls the boat in a direction away from the platform structure. The connecting structure can be formed by a long beam structure that may include one or more beams, and that can hold a buoy beyond the boat, and with the hawser line connected between an end of the boat and the buoy. One connecting structure includes a long yoke beam which is negatively buoyant and whose outer end is connected by a chain or other tension device to the buoy, and with the beam extending at an upward incline from its inner end at the platform structure to its outer end at the buoy. Another connecting structure includes a pair of beams connected in series, with a first beam that is connected to the platform structure being positively buoyant and the second beam which connects to the buoy being negatively buoyant. A beam can be utilized that can be held at any compass heading within a wide range, to enable adjustment of the compass heading of a moored boat, while still securely holding the boat in position and orientation.

Although particular embodiments of the invention have been described and illustrated herein, it is recognized that modifications and variations may readily occur to those skilled in the art and consequently, it is intended that the claims be interpreted to cover such modifications and equivalents.

The embodiments of the invention in which an exclusive property or privilege is claimed are defined as follows:

1. A platform and boat mooring system comprising:

a platform structure which is anchored at a substantially fixed location to a seabed and which extends above the surface of the sea;

a connecting structure having an inner end coupled to said platform structure at a location above the seabed, an outer location spaced from said platform structure, and a middle portion which lies underwater so a boat can float above it;

a boat having bow and stern end portions; and at least one hawser connecting a first of said end portions of said boat to said platform structure, and a second hawser connecting a second of said end portions of said boat which is opposite said first end portion, to said outer location of said connecting structure, said outer location being farther from said platform structure than said second end portion of said boat so that said boat is pulled in opposite directions by said hawsers;

said connecting structure including rigid beam means that resist compressive loading tending to move its outer location towards said platform, so that the connecting structure outer location does not have to be separately anchored to the sea floor to hold it away from the platform.

2. In combination with a platform structure which is anchored at a substantially fixed location and compass orientation to a seabed and which extends above the surface of the sea, the improvement of a boat mooring system for holding a boat in a confined position near the platform structure, comprising:

a buoy;

a beam structure having an inner end pivotally mounted on said platform structure and a free outer end spaced from said platform structure, said beam structure lying totally underwater along most of its length to permit a boat to sail over the beam structure; and a coupling connecting the outer end of the beam structure to said buoy;

said platform structure and buoy having hawser line connector means for connecting to hawser lines that can hold a boat, whereby opposite ends of a boat can be respectively connected by hawser lines to the buoy and platform structure to hold the boat of a substantially fixed location and compass heading over the seabed.

3. The improvement described in claim 2 wherein:

said beam structure includes a substantially rigid beam having an inner end lying below the sea surface and pivotally connected about a substantially horizontal axis to said platform structure, and an outer end, said buoy supportin said outer end of said beam at a higher level than the inner end thereof when the buoy is allowed to float freely, and said beam being negatively buoyant, whereby pulling of the buoy towards the platform structure by a moored boat causes energy absorption by lifting of the beam.

4. A method for mooring a boat with bow and stern ends, at a controlled position and orientation adjacent to a platform structure, comprising:

holding a buoy so it tends to remain at a predetermined position at a location spaced further from said platform structure than the length of said boat as measured between its bow and stern ends, and so the buoy is biased to tend to return to said position when deflected toward the platform structure; and connecting at least a first hawser line between a first end of said boat and said platform structure, and connecting a second hawser line between a second end of said boat and said buoy, said lines being taut to deflect said buoy away from said position in a direction generally toward said platform structure;

said step of holding the buoy including pivotally connecting an inner end of a beam structure which is longer than the boat, to the platform structure at an underwater location, to permit the beam structure to pivot about a substantially horizontal axis, and connecting a tension transmitting device between the buoy and the outer end of the beam structure.

5. A platform and boat mooring system comprising:

a platform structure which is anchored at a substantially fixed location and compass orientation to a seabed and which extends above the surface of the sea;

a connecting structure having an inner end coupled to said platform structure at a depth closer to the sea surface than the seabed, and an outer location spaced from said platform structure;

a boat having bow and stern end portions; and at least one hawser connecting a first end portion of said boat to said platform structure, and a second hawser connecting a second end portion of said boat to said outer location of said connecting structure, said outer location being further from said platform structure than said second end portion of said boat;

said connecting structure including a first beam having an inner end pivotally connected to said platform structure and an outer end, said first beam being positively buoyant, and a second beam having an inner end pivotally connected to the outer end of said first beam and an outer end, said second beam being negatively buoyant, said connecting structure also including a buoy and a coupling connecting the outer end of said second beam to said buoy; and said second hawser extends between said buoy and said boat.

6. A platform and boat mooring system comprising:

a platform structure which is anchored at a substantially fixed location and compass orientation to a seabed and which extends above the surface of the sea;

a catenary line extending from a location on said platform structure which is closer to the sea surface than the sea floor, and at a generally downward incline to the sea floor and anchored to the sea floor;

a buoy;

a tension line connecting said buoy to a location along said catenary line which is spaced from said platform structure;

a boat having bow and stern end portions; and at least one hawser connecting a first end portion of said boat to said platform structure, and a second hawser connecting a second end portion of said boat to said buoy, said buoy being further from said platform structure than said second end portion of said boat.

7. A platform and boat mooring system comprising:

a platform structure which is anchored at a substantially fixed location and compass orientation to a seabed and which extends above the surface of the sea;

a connecting structure having an inner end coupled to said platform structure at a depth closer to the sea surface than the seabed, and an outer location spaced from said platform structure;

a boat having bow and stern end portions; and at least one hawser connecting a first of said end portions of said boat to said platform structure, and a second hawser connecting a second of said end portions of said boat to said outer location of said connecting structure, said outer location being farther from said platform structure than said second end portion of said boat;

said connecting structure including a substantially rigid beam having an inner end with two horizontally spaced portions, said outer location of said connecting structure having a narrow width and the horizontally spaced portions of said inner end being horizontally spaced by a distance that is greater than the width of the outer end of the connecting structure, each of said horizontally spaced portions of said inner end being pivotally mounted about a horizontal axis on said platform structure at an underwater location that is closer to the water surface than to the seabed, and having an outer end spaced from the platform structure, said connecting structure also including means for coupling the outer location of said beam to said boat, whereby to resist the high bending loads resulting from any tendency of the boat to change heading.

8. In combination with a platform structure which is anchored at a substantially fixed location and compass orientation to a seabed and which extends above the surface of the sea, the improvement of a boat mooring system for holding a boat in a confined position and compass orientation near the platform structure, comprising:

a buoy;

an underwater beam structure having an inner end pivotally mounted on said platform structure and an outer end spaced from said platform structure; and a coupling connecting the outer end of the beam structure to said buoy;

said platform structure and buoy having hawser line connector means for connecting to hawser lines that can hold a boat, whereby opposite ends of a boat can be respectively connected by hawser lines to the buoy and platform structure to hold the boat at a substantially fixed location and compass heading over the seabed;

said beam structure having a pair of beams, including a first beam having an inner end lying below the sea surface and pivotally connected about a substantially horizontal axis to said platform structure, said first beam having an outer end, and including a second beam having an inner end pivotally connected to the outer end of said first beam about a substantially horizontal axis and having an outer end forming the outer end of the beam structure;

said first beam being positively buoyant and said second beam being negatively buoyant.

9. The improvement described in claim 8 wherein:

said first beam inner end has a pair of laterally spaced locations that are each pivotally mounted about a horizontal axis on said platform structure, whereby to resist high bending loads from any tendency of the boat to change heading.

10. A platform and boat mooring system comprising:

a platform which is anchored at a substantially fixed location to a seabed and which extends above the sea surface;

a connecting structure having an inner end mounted to said platform to resist pivoting about a vertical axis, and having an outer end lying far from the platform and being free of direct anchoring to the seabed;

a boat lying between, and having opposite boat ends respectively connected to, said platform and to said outer end of said connecting structure;

said connecting structure constructed to resist compression between its opposite ends, and including two beams connected in series about a horizontal axis and having a buoyancy distribution that urges each beam to extend primarily horizontally, and said connecting structure including a buoy connected to the end of one of said beams which is furthest from said platform, said buoy being connected to said boat.

11. A platform and boat mooring system comprising:

a platform structure which is anchored at a substantially fixed location to a seabed and which extends above the surface of the sea;

a connecting structure having an inner end coupled to said platform structure and an outer location spaced from said platform structure;

a boat having bow and stern end portions; and at least one hawser connecting a first end portion of said boat to said platform structure, and a second hawser connecting a second end portion of said boat which is opposite said first end portion, to said outer location of said connecting structure, said outer location being farther from said platform structure than said second end portion of said boat so that said boat is pulled in opposite directions by said hawsers;

said connecting structure including a beam that resists compression and that has an inner end pivotally connected about a substantially horizontal axis to said platform structure and an outer end lying under water, a buoy, and a coupling connecting said outer end of said beam to said buoy;

said second hawser extending between said buoy and said boat.

12. The system described in claim 11 wherein: said beam is longer than said boat, and at least the middle of said beam lies at a greater underwater depth than the bottom of said boat.

13. A platform and boat mooring system comprising:

a platform structure which is anchored at a substantially fixed location to a seabed and which extends above the surface of the sea; and a connecting structure having an inner end coupled to said platform structure and an outer location spaced from said platform structure;

said connecting structure including first and second beams having adjacent ends connected in series, and also includes a buoy, the first beam having another end pivotally connected to said platform structure and said second beam having another end coupled to said buoy, said beams and buoy having a buoyancy distribution that causes the beams to extend primarily horizontally when the buoy is not being pulled toward the platform structure, whereby a boat can be tied at different boat locations respectively to the platform structure and to the buoy location to hold the boat at a substantially constant heading.

14. A platform and boat mooring system comprising:

a platform structure which is anchored at a substantially fixed location to a seabed and which extends above the surface of the sea; and a connecting structure having an inner end coupled to said platform structure and an outer location spaced from said platform structure;

said connecting structure including a beam having an inner end pivotally connected to said platform structure to permit pivoting about a substantially vertical axis, and a pair of adjustable tying means tied to locations on said platform that lie on laterally opposite sides of said beam inner end and with each tying means extending to a beam location spaced from said beam inner end, for fixing the orientation of said beam about said vertical axis, whereby to enable the boat to be moored at any compass heading within a wide range.

* * * * *